US005946811A

United States Patent [19]

Chang

[11] Patent Number: 5,946,811

[45] Date of Patent: Sep. 7, 1999

[54] SIDE CUTTING CAN OPENER WITH A DOUBLE GRIP

[75] Inventor: Kun-Jen Chang, Yung Kang Shih, Taiwan

[73] Assignee: Alston Development Co., Ltd., Tainan Hsien, Taiwan

[21] Appl. No.: 08/963,982

[22] Filed: Nov. 4, 1997

[51] Int. Cl.[6] ..... B67B 7/72

[52] U.S. Cl. ..... 30/417; 30/422

[58] Field of Search ..... 30/417, 418, 416, 30/422; D8/37, 41

[56] References Cited

U.S. PATENT DOCUMENTS

| | | | |
|---|---|---|---|
| 4,726,119 | 2/1988 | Lee | 30/418 |
| 4,782,594 | 11/1988 | Porucznik et al. | 30/417 |
| 4,825,554 | 5/1989 | Koo | 30/417 |
| 5,181,322 | 1/1993 | Koo | 30/416 |
| 5,347,720 | 9/1994 | Pereira | 30/422 |
| 5,692,309 | 12/1997 | Pereira | 30/417 |

FOREIGN PATENT DOCUMENTS

| | | | |
|---|---|---|---|
| 419878 | 3/1967 | Switzerland | 30/417 |

*Primary Examiner*—Hwei-Siu Payer
*Attorney, Agent, or Firm*—Bacon & Thomas

[57] ABSTRACT

A side cutting can opener with a double grip includes an upper and a lower grip. When the two grips are closed, a cutter and a pull wheel can clamp a lip of a can and cut an outer edge of the lip off with the cutter rotated by a rotatable grip. The upper and the lower grip respectively has a combine end facing each other and provided with a ratchet wheel. The two grips are easily closed vertically from an open position to force the cutter and the pull wheel clamp the lip of a can. Then the rotatable grip at the right side of the grips can be easily rotated to force the cutter move along and cut the outer edge of the lip of a can.

3 Claims, 7 Drawing Sheets

SIDE CUTTING CAN OPENER WITH A DOUBLE GRIP

BACKGROUND OF THE INVENTION

This invention relates to a side cutting can opener with a double grip, particularly to one having a double grip to be easily gripped to close for clamping the lip of a can, and easily rotate a rotatable grip for cutting the annular side of the upper lid of a can.

A side cutting can opener is used to cut an outer edge of the lip of a can. In performing cutting operation, a pull wheel moved by a grip and a cutter clamp an inner and outer edge of the lip of an upper (or lower) end of a can, and then the grip is held on the outer edge of the lip of the can with one hand, and a rotatable grip, fixed on the grip and moving with the same axis with the pull wheel, is rotated with another hand. Then the pull wheel moves along the inner edge of the lip of the can, by rotation of the rotatable grip, and the cutter moves along and cut the outer edge of the lip of the can so that the cut-off portion of the can may form a can cap possible to over on the opened portion. Further, the cutter does not extend in the can, with the food in the can not becoming dirty. So the can opener of this structure is better hygienically than conventional can openers.

The side cutting can opener operates firstly to clamp the lip edge of a can and then rotating the rotatable grip for cutting the outer edge of the can. Conventional side cutting can openers are classified into two kinds, a single grip and a double grip. Those of the single grip uses a rotatable grip for clamping the lip edge of a can by controlling a pull wheel in moving laterally. Then in clamping the lip edge of a can the rotatable grip has to be turned back, enlarging the gap between the pull wheel and the cutter for the lip edge of the can to move therein, and then the rotatable grip is turned forward again to shorten the gap between the pull wheel and the cutter to clamp the lip edge of the can more tightly so as to begin cutting precess, resulting in inconvenient handling. In addition, clamping action often fails.

As to the conventional side cutting can opener with the double grip has the double grip located at the right horizontal side for clamping, and the rotatable grip, moving with the same axis as the pull wheel, is operated on the double grip, so the other hand rotating the rotatable grip has to be elevated a little higher than the hand holding the double grip. Therefore a user feels very tiresome in rotating the rotatable grip. Traditional upside cutting can openers with double grips instead of side cutting, have a double grip vertically closed, far better for most consumers to use. But those with the double grip being clamped horizontally is not so suitable for most consumers.

SUMMARY OF THE INVENTION

The purpose of the invention is to offer a side cutting can opener with double grips, having the double grip being closed in a vertical direction instead of a horizontal direction, and a rotatable grip located at the right side of the double grip for convenience of use by common consumers.

BRIEF DESCRIPTION OF DRAWINGS

This invention will better understood by referring to the accompanying drawings, wherein.

DETAILED DESCRIPTION OF THE PREFERRED EMBODIMENT

Figure 1:
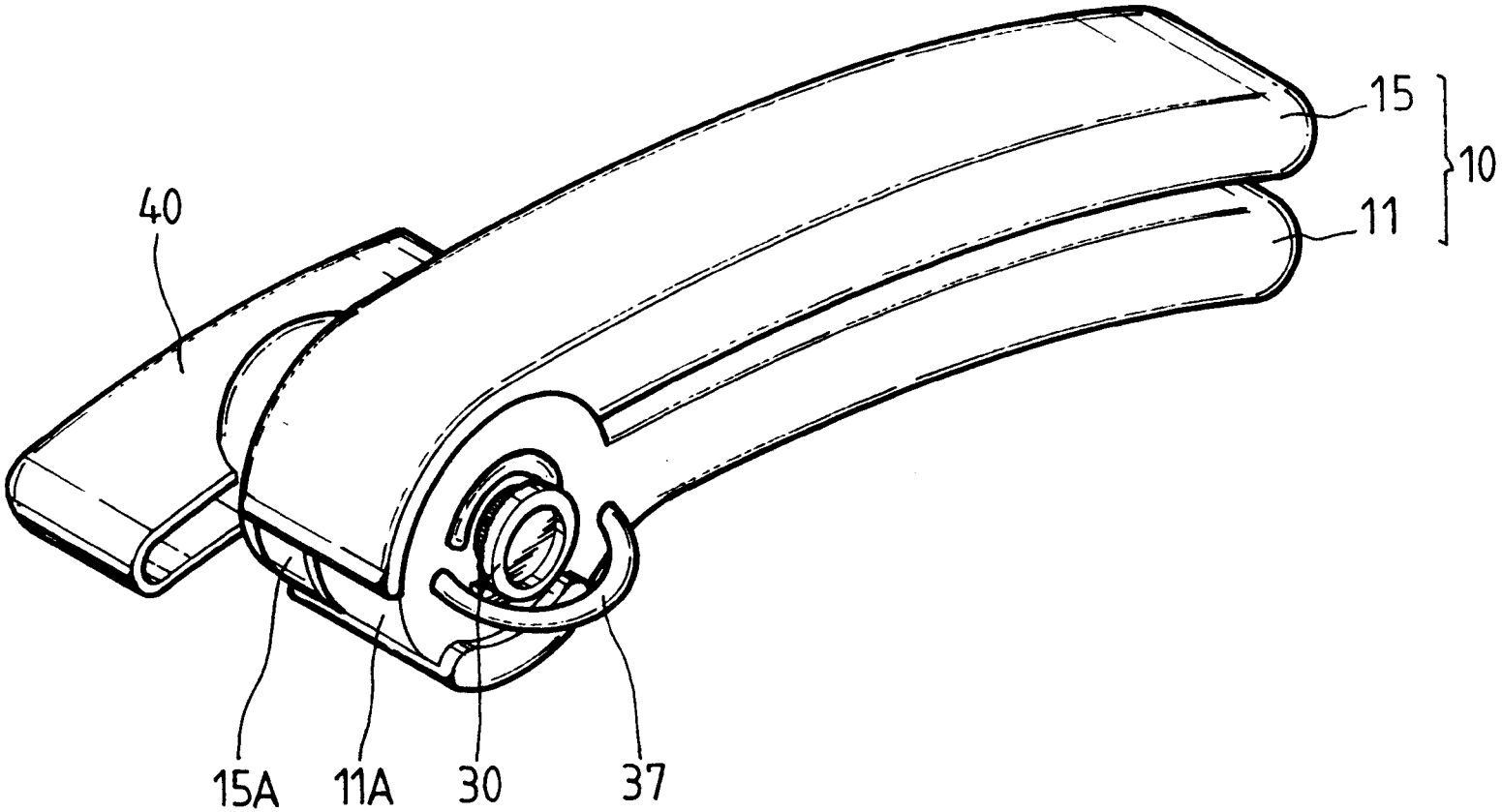
FIG. 1 is a perspective view of a side cutting can opener with a double grip in the present invention.
Figure 2:
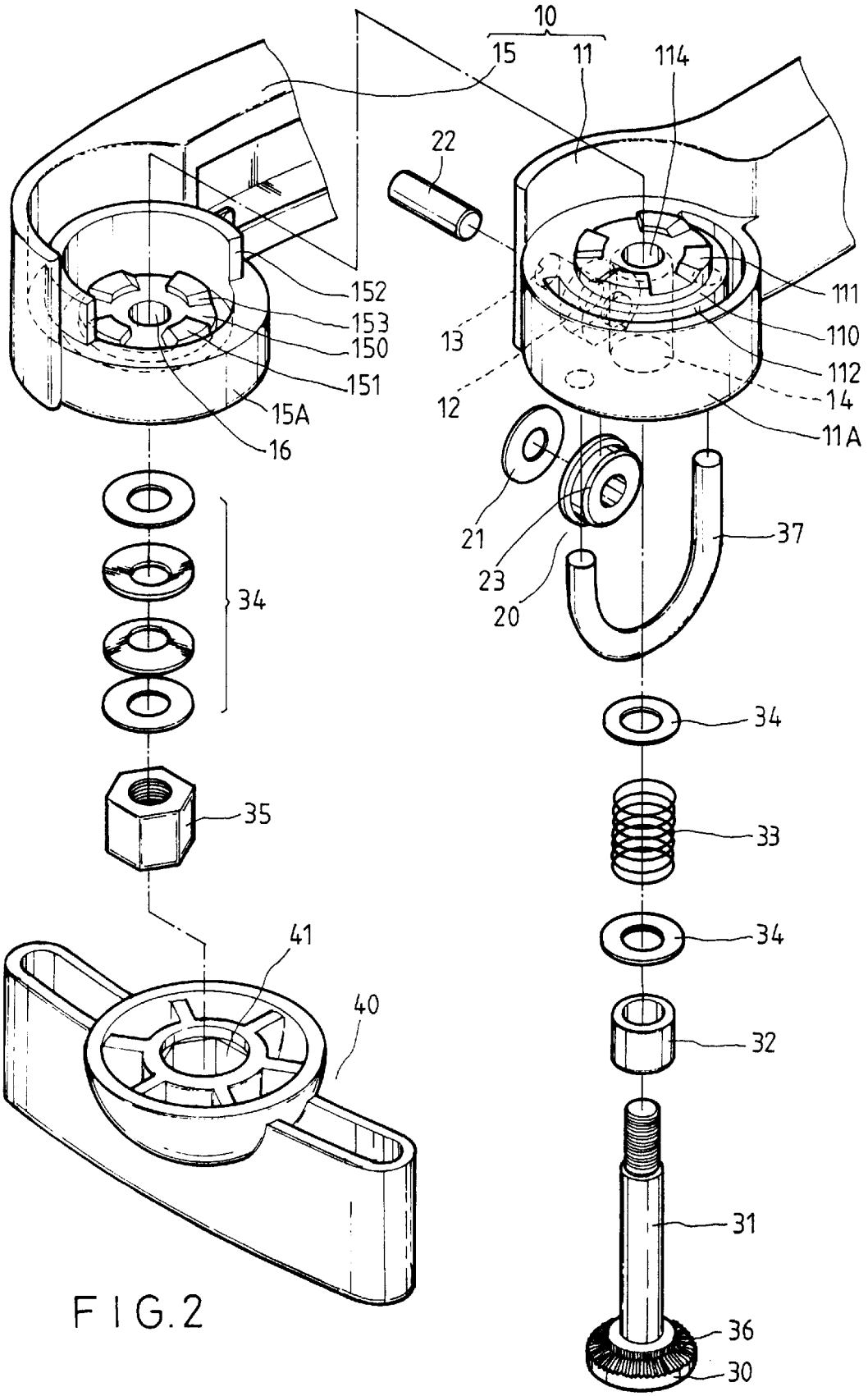
FIG. 2 is an exploded perspective view of the side cutting can opener with a double grip in the present invention.

A side cutting can opener with a double grip in the present invention, as shown FIGS. 1 and 2, includes a double grip 10 having two—an upper and a lower—grips 15 and 11, a circular cutter 20 to be positioned at an outer edge of a lip of a can clamped by the two grips 15, 11 when the two grips 15, 11 are closed against each other, a pull wheel 30 to be positioned in an inner edge of the lip of a can forming a pliers mouth with the cutter 20, and a rotatable grip 40 rotated manually to force a blade 23 of the cutter 20 move along and cut an outer edge of the lip of a can.

The double grip 10 is combined with the cutter 20 by means of a cutter cavity 12 formed in a side of a combine end of the lower grip 11 and a position hole 13 formed vertical to the cutter cavity 12. After the cutter 12 with a gasket 21 are placed in the cutter cavity, a cutter shaft 22 is inserted through the position hole 13 and a center hole of the cutter 12 and the gasket 21, keeping the cutter 20 and the gasket 21 in place securely. Thus the cutter 20 is positioned in its place comparatively stabilized by means of the gasket 21 and the cutter shaft 22.

Figure 3:
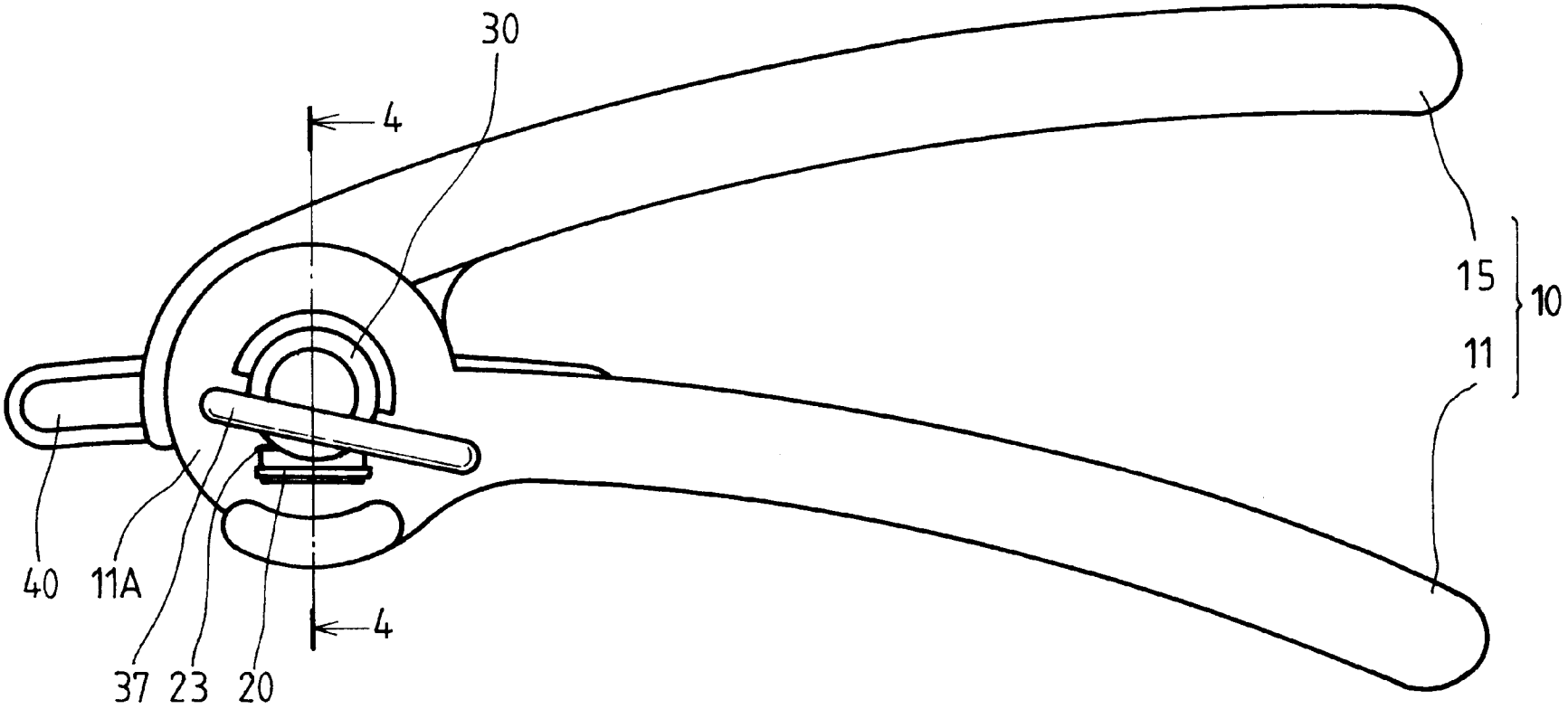
FIG. 3 is a side view of the side cutting can opener with a double grip in the present invention, with two grips spread open, not clamping a can.

Next, the double grip 10 is combined with the pull wheel 30 by means of a shaft portion 31 of the pull wheel 30 orderly fitted around by a sleeve 32, a gasket 34, a coil spring 33 and another gasket 34. Then the shaft portion 31 passes through a center shaft hole 114 of the lower grip 11. As the diameter of the shaft hole 114 only allows the shaft portion 31 to extend therein, the sleeve 32, the spring 33 and the two gaskets 34, 34 remain in a straight hole 14 of a larger diameter in the combine end of the lower grip 11 than the shaft hole 114. Further, after the shaft portion 31 passes through the lower grip 11, it passes through a shaft hole 16 in a combine end of an upper grip 15 and a number of buffer gaskets 34 (maybe four, the front most and the rear most are flat, and the intermediate two are dish-shaped with back against back) and then screwed tightly with a nut 35. Therefore, the upper grip 15 and the lower grip 11 of the double grip 10 can be closed vertically to each other or spread to part farther from each other, as shown in FIG. 3, with the shaft portion 31 of the pull wheel 30 functioning as a shaft.

Figure 10:
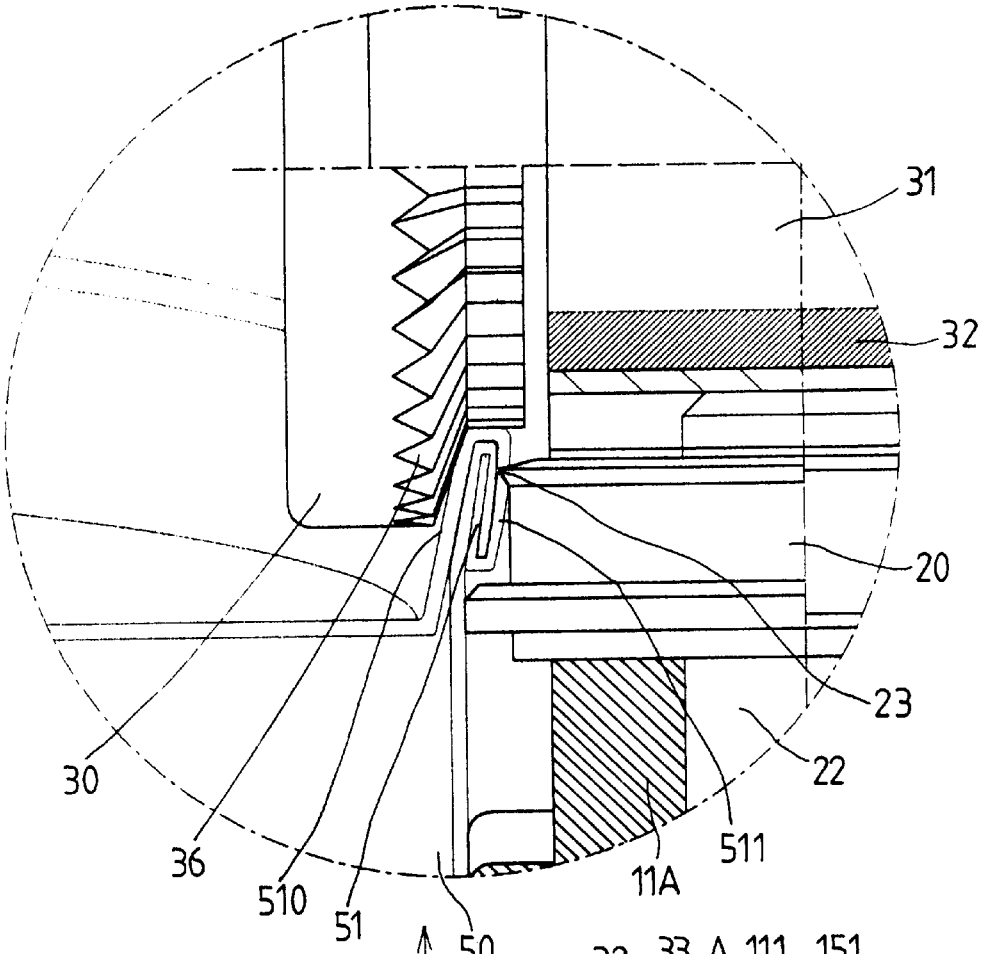
Figure 9:
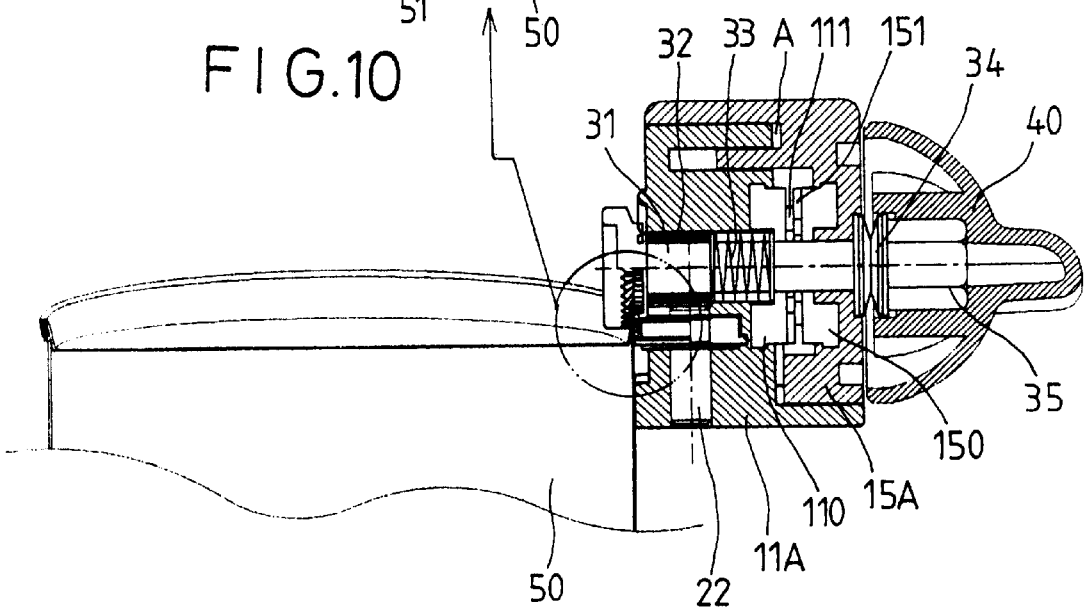
FIG. 9 is a side cross-sectional view of the side cutting can opener with a double grip in the present invention, in cutting a can; and, FIG. 10 is an enlarged view of the cutting part marked P in FIG. 9.

The pull wheel 30 is combined with the rotatable grip 40 by means of the nut 35 of a non-round shape to fit immovably in a nut hole 41 formed in the rotatable grip 40 so that a wheel surface 36 of the pull wheel and the blade 23 of the cutter 20 may function as a pliers to respectively clamp the inner edge 510 and the outer edge 511 of the lip 51 of a can 50 as shown in FIGS. 9 and 10 during cutting operation of the can opener. And the rotatable grip 40 is located at one end of the pull wheel 30, having the same axis as the pull wheel. So when the rotatable grip 40 is rotated, the wheel surface 36 moves along the inner edge 510 of the lip 51 of the can 50, forcing the blade 23 of the cutter 20 move along and cut the outer edge 511 of the lip 51 of the can 50 at the same time, performing cutting action of the can opener. In addition, a U-shaped support rod 37 provided at the same side of the pull wheel 30 functions to protect the pull wheel 30.

The main improvement of the present invention is the structure of the double grip 10 in closing and spreading action, by means of the upper grip 15 and the lower grip 11 and the combine ends 15A and 11A of the two grips 15 and 11. The combine ends 15A and 11A are respectively provided with an upper ratchet wheel 150 and a lower ratchet wheel 110 made of an anti-wear metal, formed integral with the upper and the lower grip 15, 11.

The upper ratchet wheel 150 has a plurality of ratchet teeth 151, (four in this embodiment, but not limited in its number) spaced apart in an annular shape on an end surface facing the lower ratchet wheel 110, and a fan-shaped Position wall 152 provided to stand upright on an upper surface. Further, each ratchet tooth 151 has a sloped guide face 153 in a radial direction or a clockwise direction, as shown in FIG. 2.

The lower ratchet wheel 110 also has a plurality of ratchet teeth 111 as those 151 of the upper ratchet wheel 150, and a fan-shaped position groove 112 of the same length as the fan-shaped position wall 152 of the upper ratchet wheel 150 for the same wall 152 to fit therein for limiting movement of the both ratchet wheels 110 and 150.

When the double grip 10 is manually closed up or spread open, it has two kinds of engaging conditions, which is to be described below.

Figure 5:
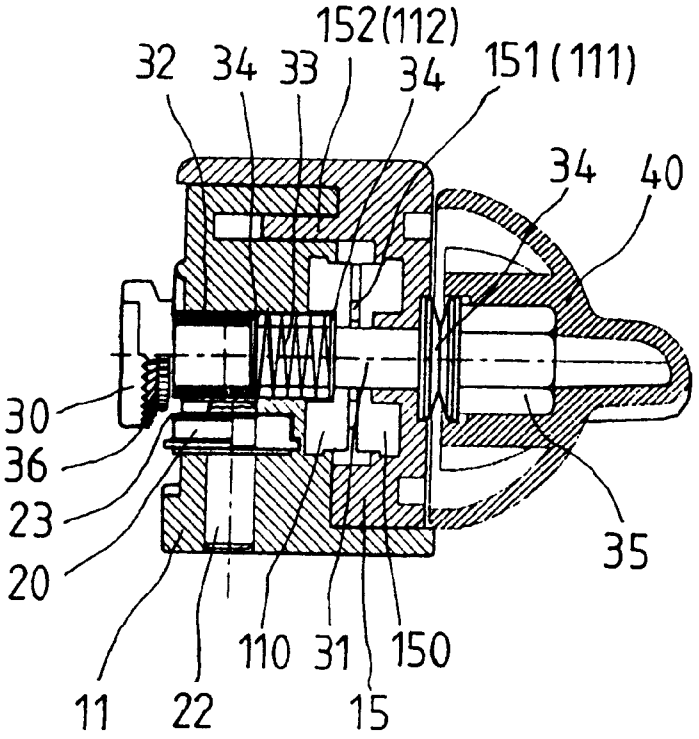
FIG. 5 is a side cross-sectional view of line 4—4 in FIG. 3.
Figure 4:
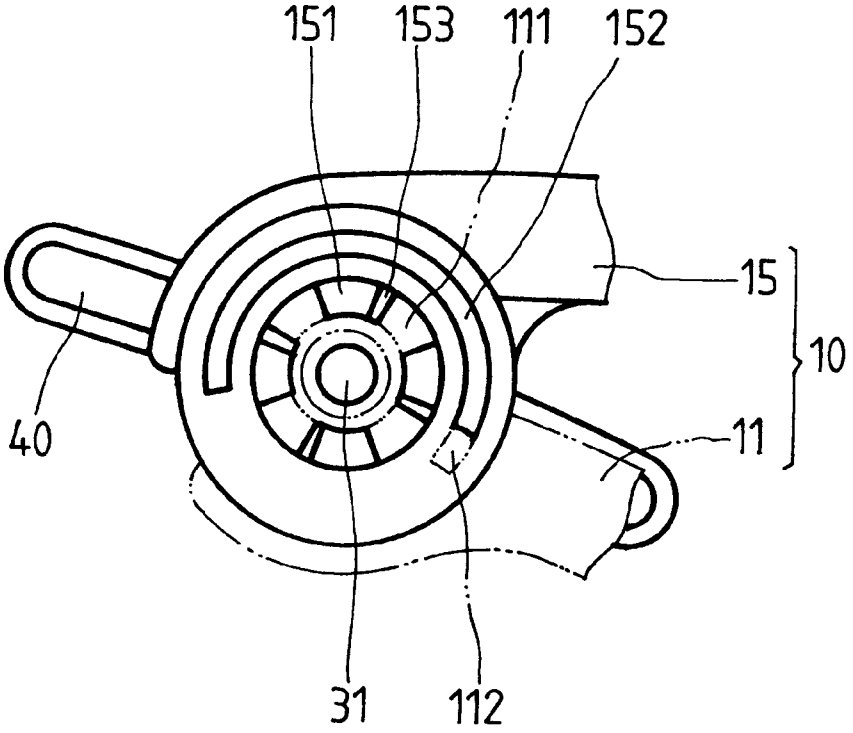
FIG. 4 is an upper view of a cross-section of line 4—4 in FIG. 3.

The first kind of engaging condition is shown in FIGS. 3, 4 and 5, with the upper and the lower grip 15 and 11 being in a spread open condition (in fact, this condition is a preparatory one before this can opener begins to cut open a can). Then the upper ratchet wheel 150 and the lower ratchet wheel 110 are engaging with each other, in other words, the ratchet teeth 151 and 111 fit in gaps formed between every two ratchet teeth 151 and 111, forced by the coil spring 33 elastically pushing the lower ratchet wheel 110 to move to contact the upper ratchet wheel 150, with the pull wheel 30 staying immovable, not to move laterally. The cutter 20 moves to the upper ratchet wheel 150, moving together with the lower grip 11 to the position shown in FIG. 5, with the gap between them being the largest for them to stride the lip 51 of a can 50, and with the wheel surface 36 of the pull wheel 30 and the blade 23 of the cutter 20 respectively resting on the inner edge 510 and the outer edge 511 of the lip 51 of the can 50, as shown in FIGS. 9 and 10.

Figure 6:
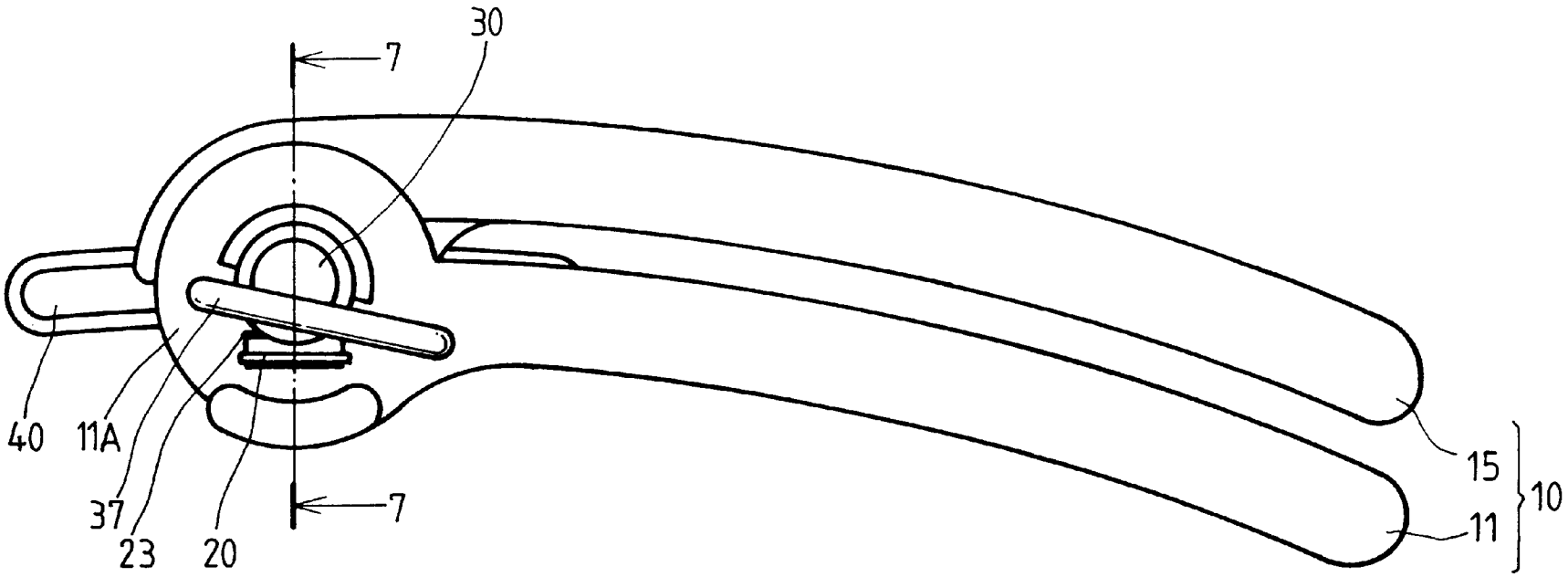
FIG. 6 is a side view of the two grips closed for clamping in the present invention.
Figure 8:
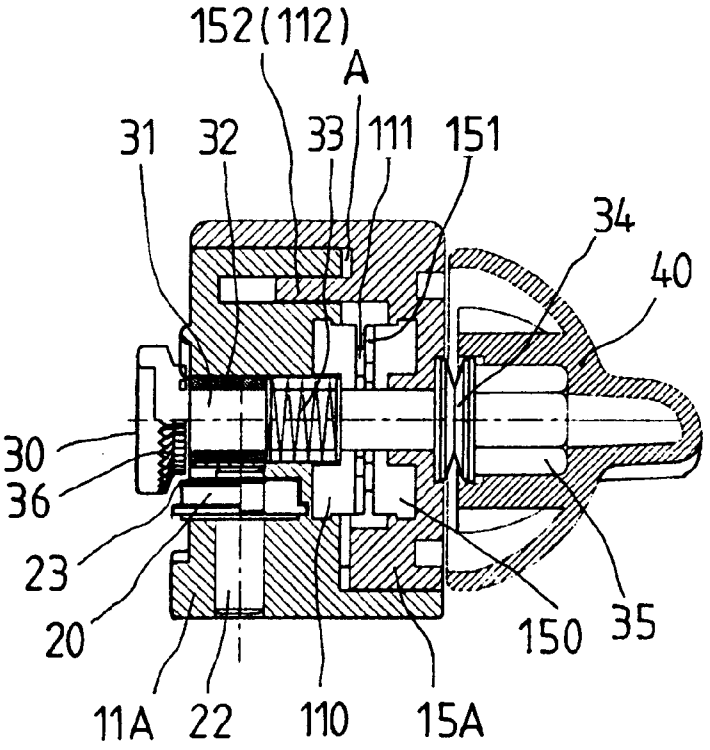
FIG. 8 is side cross-sectional view of line 7—7 in FIG. 6.
Figure 7:
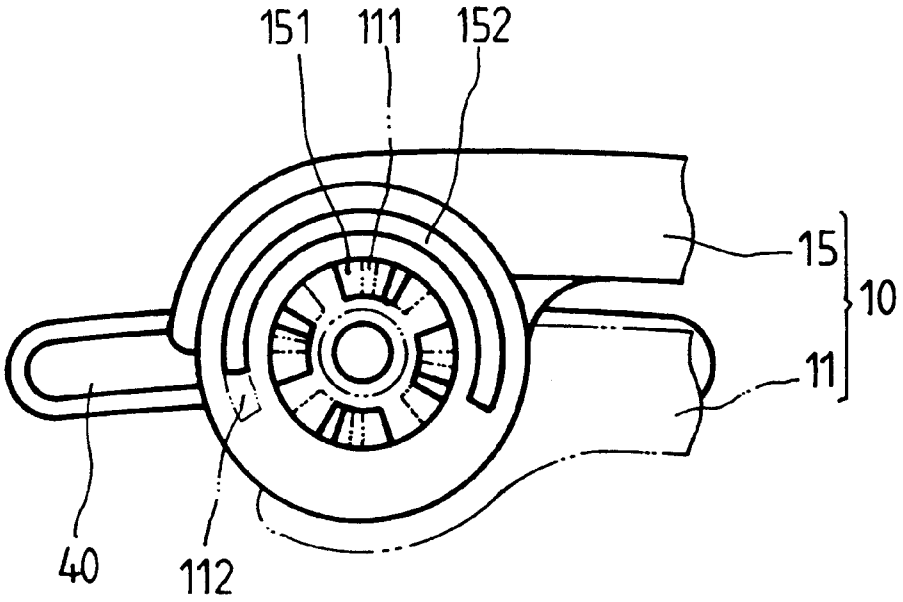
FIG. 7 is an upper view of a cross-section of line 7—7 in FIG. 6.

The second kind of the engaging condition is shown in FIGS. 6, 7 and 8, with the upper and the lower grip 15 and 11 being manually closed (in fact, this condition is for cutting operation). Then the upper and the lower ratchet wheel 150 and 110 are moved to change their location, with the ratchet teeth 151 and 111 contacting with each other, and then the lower ratchet wheel 110 of the lower grip 11 compressing the spring 33 to form a gap A with the upper ratchet wheel 150 as shown in FIG. 8. Therefore, the gap between the pull wheel 30 and the cutter 20 is shortened to permit the pull wheel 30 and the cutter 20 clamp the lip 51 of the can 5 as shown in FIGS. 9 and 10, and the rotatable grip 40 can be directly rotated force the cutter 20 to cut the can lid off.

As can be understood from the above description, the can opener in the present invention has the effect of cutting an outer edge of a can lid, and its important feature is spreading and closing movement of the upper and the lower grip 15 and 11 for clamping the lip of a can at the upper side and at the lower side, in the same manner as the conventional can opener with two grips so as to suit the habit of consumers in operation. Further, the rotatable grip moving in the same axis as the pull wheel is located at the right side of the double grip so that when a user performs cutting operation with this can opener, the user may do it with ease and convenience. In addition, the vertical closing of the upper and the lower grip and the gap adjusting structure of the cutter and the pull wheel are not seen in the conventional can openers.

While the preferred embodiment of the invention has been described above, it will be recognized and understood that various modifications may be made therein and the appended claims are intended to cover all such modifications which may fall within the spirit and scope of the invention.

I claim:

1. A side cutting can opener with a double grip comprising:

said double grip consisting of an upper grip and a lower grip in a horizontal position each of said upper and lower grips having a combine end;

a circular cutter positioned in said combine end of one of said upper and lower grips, to clamp an outer edge of a lip of a can, and used to cut the outer edge of the lip of the can;

a pull wheel forming a clamp gap with said cutter in performing cutting operation, having a shaft portion passing through said combine ends of said two grips, a coil spring fitting around said shaft portion and to elastically pushing a lower one of said two combine ends, which then move to contact with each other;

a U-shaped support rod fixed on a side of said lower grip for protecting said pull wheel;

a rotatable grip fixed with an outer end of said pull wheel, forcing said pull wheel to move along an inner edge of the lip of the can and also forcing said cutter to move along and cut the outer edge of the lip of the can in performing cutting operation; and, characterized by said upper and lower grips of said double grip being located one on the other, said combine ends of said upper and lower grips facing inward to each other and respectively provided with a ratchet wheel, each said ratchet wheel having a plurality of ratchet teeth spaced apart in an annular shape on an upper surface thereof, each said ratchet tooth having a sloped side in a radial direction, one of said ratchet wheels having a fan-shaped upright position wall and the other of said ratchet wheels having a position groove of the same length as said fan-shaped position wall for receiving said position wall so as to limit said two ratchet wheels in movement, said two ratchet wheels of said upper and lower grips having said ratchet teeth engaging with one another to shorten a gap between said two ratchet wheels and then widen a gap between said cutter and said pull wheel so as to let the lip of the can fit in said gap when said upper and lower grips are spread open, said ratchet teeth of said two ratchet wheels moved to face one another to let said gap between said cutter and said pull wheel shortened to let the lip of the can clamped by said cutter and said pull wheel for cutting the outer edge of the lip of the can when said upper and lower grips are closed up.

2. The side cutting can opener with a double grip as claimed in claim 1, wherein said cutter and said pull wheel are located under said combine end of said lower grip, and said rotatable grip is located on said upper grip, with the rotatable grip being in different location from said cutter and said pull wheel.

3. The side cutting can opener with a double grip as claimed in claim 1, wherein said ratchet wheels are made of a metal of anti-wear and respectively formed integral with said upper and lower grips.

* * * * *